United States Patent [19]

Prestenbach

[11] Patent Number: 4,817,554

[45] Date of Patent: Apr. 4, 1989

[54] MARSH CRAFT TRACK ADAPTER

[76] Inventor: Perry J. Prestenbach, 30 Highway 90 East, Houma, La. 70364

[21] Appl. No.: 72,093

[22] Filed: Jul. 10, 1987

[51] Int. Cl.[4] ..... B62D 55/12

[52] U.S. Cl. ..... 114/270; 180/6.48; 440/95

[58] Field of Search ..... 114/270; 440/95; 180/6.48; 305/40, 45, 16, 17, 18

[56] References Cited

U.S. PATENT DOCUMENTS

| | | | |
|---|---|---|---|
| 851,517 | 4/1907 | Hildebrand | 305/18 |
| 1,192,423 | 7/1916 | Henneuse | 305/17 |
| 1,318,008 | 10/1919 | Johnson | 305/17 |
| 3,645,350 | 2/1972 | Deli et al. . | |
| 3,674,105 | 7/1972 | Egli . | |
| 3,807,521 | 4/1974 | Sargent | 180/6.48 |
| 3,842,785 | 10/1974 | Rivet | 114/270 |
| 3,853,193 | 12/1974 | Duann | 180/6.48 |
| 3,872,939 | 3/1975 | Eckert . | |
| 3,893,531 | 7/1975 | Gee | 114/313 |
| 4,124,124 | 11/1978 | Rivet . | |
| 4,262,764 | 4/1981 | Kraus . | |
| 4,433,634 | 2/1984 | Coast . | |
| 4,537,268 | 8/1985 | Fuakushima | 180/6.48 |

FOREIGN PATENT DOCUMENTS

| | | | |
|---|---|---|---|
| 517777 | 3/1955 | Italy | 305/18 |
| 889546 | 2/1962 | United Kingdom | 180/6.48 |

*Primary Examiner*—Sherman D. Basinger
*Assistant Examiner*—Thomas J. Brahan
*Attorney, Agent, or Firm*—Hoffman, Wasson, Fallow & Gitler

[57] ABSTRACT

Disclosed herein is an adapter for rendering an earth mover amphibious, comprising a buggy assembly having a pair of buoyant pontoons and tracks that are driven around the pontoons by hydraulic motors situated coaxially with drive sprockets for the track. The track is driven by the motor without an intermediate chain drive, thus avoiding certain environmental and personal dangers.

5 Claims, 3 Drawing Sheets

MARSH CRAFT TRACK ADAPTER

BACKGROUND OF THE INVENTION

This invention relates to land and amphibious vehicles generally and in particular to amphibious earth moving equipment.

One type of amphibious vehicle has one or more pontoons around each of which an endless track is guided, the track being driven by a prime mover on the vehicle. The application of this technology to earth moving equipment enables one to produce excavators and the like suitable for use in marshy areas. The buoyancy of the pontoons is selected to be sufficient to prevent the vehicle from sinking and furthermore enables the tracks to drive the vehicle even in soft mud and mire. Various excavators and dredges of this type are well known.

Because of the limited demand for amphibious earth working vehicles, it is not commercially feasible to mass produce excavators specifically designed for marshy environments. Therefore, there is a demand for means to convert conventional dry land excavating equipment to an amphibious environment. Previous attempts to satisfy this demand have met with only limited success in part because the approaches taken were too complicated, and therefore too expensive. Some of the prior art attempts in this area utilized separate engines, one for the excavator itself, and one for the track drive, which of course increased weight, cost and maintenance requirements. Other proposals, such as those shown in U.S. Pat. Nos. 3,842,785 and 4,124,124 employed outboard lubricated chains extending between the prime mover and axles supporting the tracks on the pontoons. The drive chains presented serious environmental and safety hazards.

It is an object of this invention to provide a simple, inexpensive, uncomplicated adapter for rendering a dry land excavator amphibious.

A further object of the invention is to avoid the water pollution caused by open lubricated drive chains.

Yet another object is to enable an amphibious excavator to be driven by the standard excavator engine through its standard track motors; that is, to enable one to utilize the existing excavator engine and hydraulic motors to drive the tracks of an amphibious vehicle.

A further object is to avoid the hazards to personnel and animals posed by exposed drive chains.

The invention provides an adapter for converting a dry land earth mover to amphibious operation. The adapter comprises a pair of pontoon assemblies, each of these assemblies having a pontoon with an endless track guided around it in a generally vertical plane, a hydraulic drive motor powered by fluid from the prime mover of the excavator and a drive shaft assembly for transferring power directly from the hydraulic motor to the driven track. The drive shaft assembly includes a tube coaxial with the hydraulic motor and having an internal diameter greater than the outside diameter of the hydraulic motor to enable the tube to be placed over the hydraulic motor; a plate affixed to one end of the tube; a shaft affixed to the plate and coaxial with the tube for unitary rotation therewith; a pillow block for supporting the distal end of the shaft; and plural sprockets for supporting and driving the amphibious track, at least one of said sprockets being affixed to said tube and at least one of said sprockets being affixed to said shaft; whereby the track is driven directly from the hydraulic motor without intermediate linkage.

DESCRIPTION OF THE PREFERRED EMBODIMENT

Figure 1:
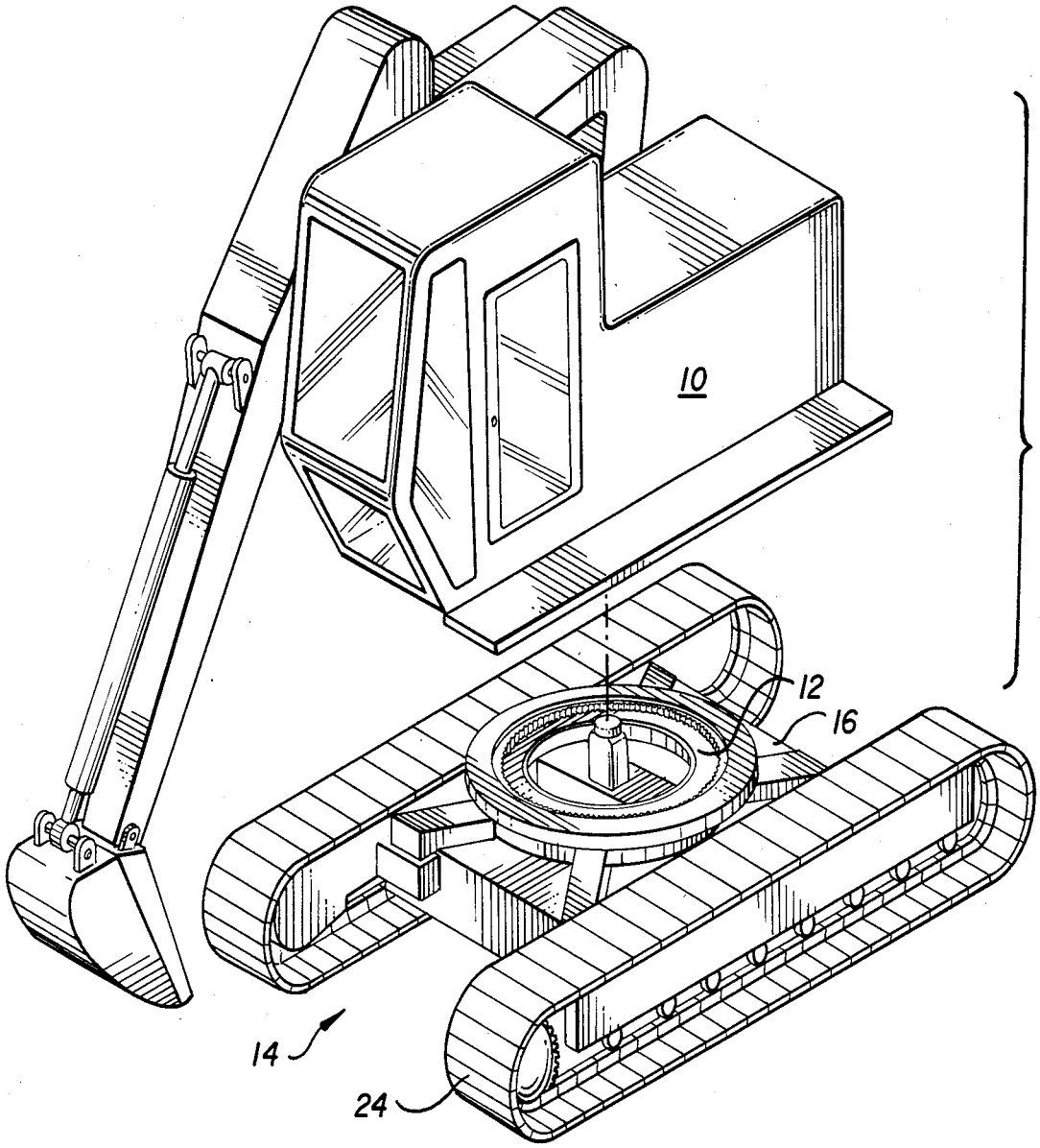
FIG. 1 (PRIOR ART)
FIG. 1 is an exploded perspective view of a dry land excavator, looking from the rear.

FIG. 1 shows a conventional earth-moving machine in an exploded view with the cab assembly 10 raised from the crawling unit or "buggy" assembly 14 for clarity. The turntable 12 permits the cab to swivel upon the buggy assembly, which assembly includes a rigid transverse frame member 16 supporting a pair of hydraulic motors (one for each track) that are powered by fluid delivered from a high-pressure pump in the cab unit via a hose. The frame supports a pair of tracks 24 driven by the respective motors. In practicing the present invention, the entire conventional buggy assembly, except for the motors and hoses, is removed from the cab assembly 10 and is set aside.

Figure 2:
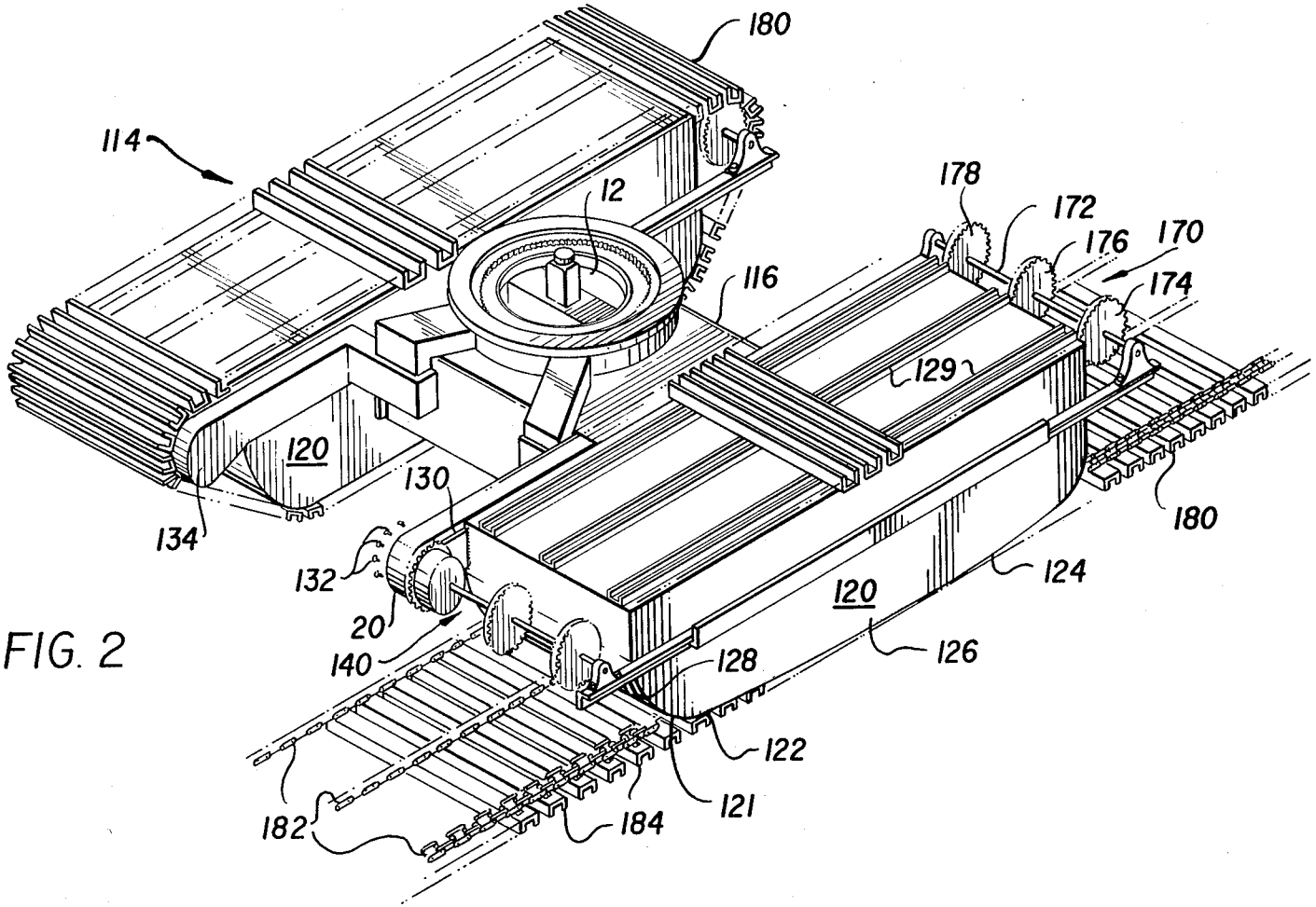
FIG. 2 is a perspective view of a pontoon assembly embodying the invention.

FIG. 2 illustrates an amphibious buggy assembly embodying the invention, wherein parts identical to those of FIG. 1 are identified by identical reference numerals. The buggy assembly 114 comprises a transverse frame 116 upon which the turntable 12 may be mounted. Opposite ends of the frame member 116 are affixed to respective buoyant pontoons 120 having sufficient volume to support the entire weight of the excavator. The width of the frame member 116 and the dimensions of the pontoons are chosen to provide the assembled final unit with adequate stability to prevent it from tipping when afloat.

The pontoons 120 have radiused front and rear ends 121 and bottom surfaces that are slightly bowed downward, comprising a pair of sloping surfaces 122, 124, with a slight dihedral angle therebetween, on either side of a three-foot long central, horizontal portion 126. This geometry is superior to that of a flat-bottomed pontoon because it enables the tracks to pivot upon the ground much more easily. Furthermore, the bowed pontoon bottom helps retain the track chains within their channels 128 along the bottom of the pontoon by maintaining a normal force therebetween when the tracks are under tension. Upper guide channels 129 are attached to the tops of the pontoons.

Figure 3:
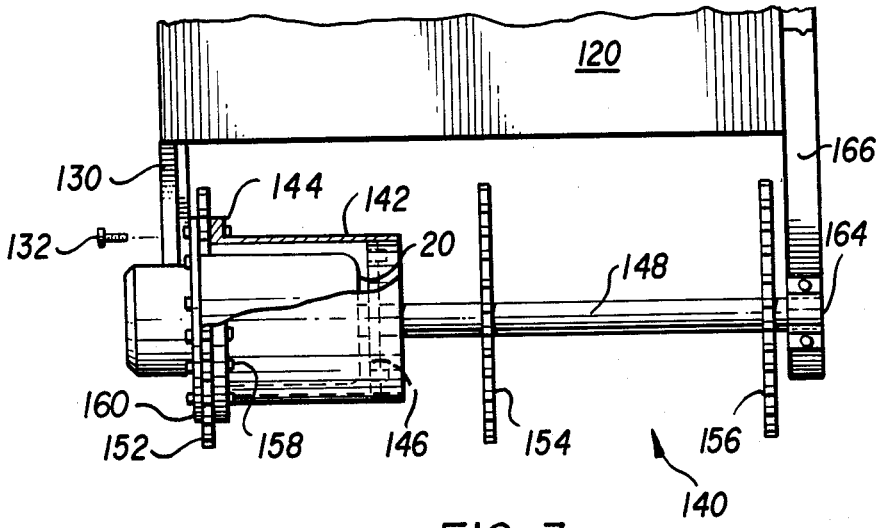
FIG. 3 is a top view of a drive shaft assembly for driving the track shown in FIG. 2.

To mount each motor 20 upon its respective pontoon 120, a bracket or motor mount 130 is welded to the rear end of the pontoon, on the inboard side, as shown in FIG. 3. The motors are then attached to their mounts by bolts 132, and this can be done without ever having to disconnect the fluid lines 22. The lines are protected by removable shields 134. Each motor is mechanically connected to a track drive assembly, described below and shown in detail in FIG. 3. Each drive assembly 140 comprises a hollow pipe or tube 142 whose inside diameter is slightly larger than the outside diameter of the hydraulic motor 20 with which it is associated. This tube has at its inboard end (the left in FIG. 3) a flange 144 affixed thereto, as by welding. The other end of the tube is closed by a circular plate 146 that is welded inside the tube. One end of a shaft 148 is attached by welding to the center of plate 146, and this shaft extends in the outboard direction so that the combined length of the tube 142 and shaft 148 approximately equals the width of the pontoon.

Each track is driven by plural, equidistantly spaced sprockets (three - 152, 154 and 156 are shown) that are supported on the shaft-tube assembly. The inboard sprocket 152 has a large inside diameter comparable to the outside diameter of the tube 142 and is attached to the motor and to the tube flange 144 by means of bolts 158. The remaining sprockets 154 and 156 are welded to the shaft 148. Three sprockets are shown, but it should be understood that two sprockets may be sufficient for some applications, while more than three may be needed in others; of course, the number of sprockets will correspond to the number of track chains.

The drive shaft assembly 140 is installed by placing the tube 142 over the motor 20, and then joining the tube flange 144 to the motor drive flange 160 with the bolts 158. The outboard, or distal, end of the shaft 148 is supported by a pillow block 164 provided on a bracket 166 connected to the outboard side of the pontoon.

The opposite, front, end of the pontoon is provided with an idler shaft assembly 170, comprising an idler shaft 172 with sprockets 174, 176, 178 secured thereto. The shaft is supported at both ends by pillow blocks similar to those described above.

FIG. 2 shows details of the tracks 180 that, when looped around the pontoons, are guided by the lower and upper channels 128, 129 and the drive shaft and idler shaft sprockets.

Figure 5:
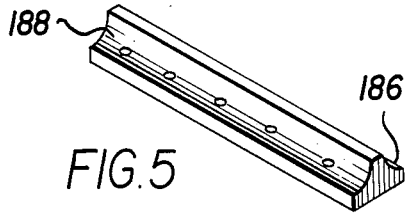
FIG. 5 shows a preferred track cleat in perspective.

Each track assembly 180 comprises plural, identical endless chains 182, and a plurality of transverse cleats 184 affixed to alternate links thereof. Each of the cleats may comprise a metal U-section, open outwardly, as shown in FIG. 2, which provides good traction in mud and mire. We prefer, however, to use T-shaped cleats 186, one of which is shown in detail in FIG. 5. The generous fillets 188 between the legs of the T, of at least an inch radius, render the cleat self-cleaning. This design avoids the substantial accumulation of mud that can detract from buoyancy with other designs.

Figure 4:
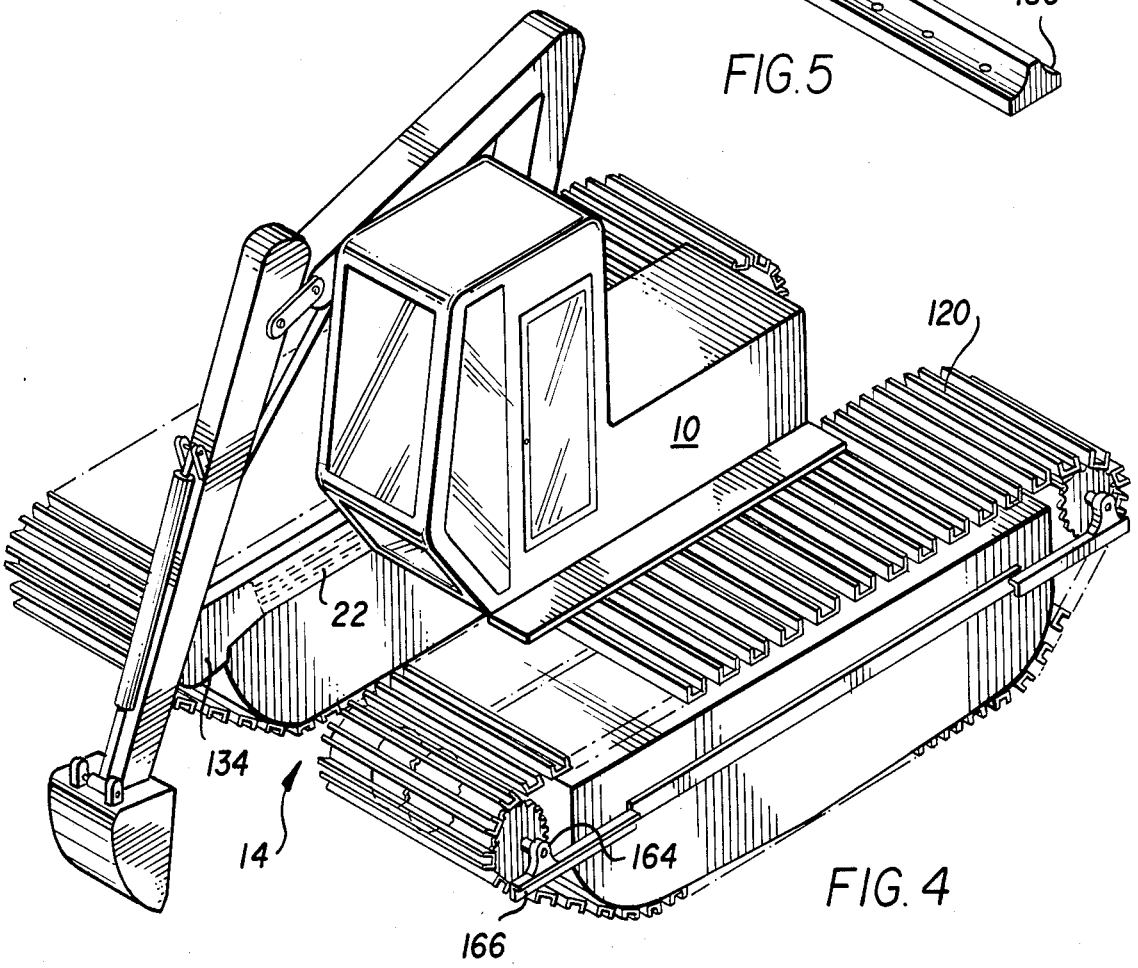
FIG. 4 is a perspective view of an amphibious excavator embodying the invention.

FIG. 4 shows the cab assembly 10 reinstalled upon the amphibious buggy assembly. Note the original hydraulic motors 20 and lines 22 for transferring fluid to and from the cab's hydraulic pump, thereby avoiding the need for a separate prime mover for the buggy.

Operation of the FIG. 4 device is identical to that of the prior art in that, when activated, the independently acting motors 20 rotate their drive shaft assemblies, which pull the tracks around the pontoons—normally in the direction indicated by the arrows in FIG. 2—resulting in movement of the excavator over dry ground or even soft mud. When the excavator is fully afloat, the tracks naturally lose a large portion of their effectiveness, and in such instances the unit may be better moved by towing or by using the excavator bucket to pull the excavator along; however, the cleats do function even in water and the excavator can "swim" slowly under its own power.

A particular advantage of the invention is that, owing to the particular structure of the drive assembly 140, the hydraulic motors 20 need not have an intermediate drive such as the exposed chain shown in U.S. Pat. No. 4,124,124, which is typical of prior art in this area. When drive chains are used in amphibious environments, inasmuch as the chains are underwater much of the time, frequent lubrication is required, and such lubrication normally needs to be done on at least a daily basis. As a result, substantial quantities of lubricant inevitably wind up in the water, presenting a particularly objectionable environmental drawback. Furthermore, the existence of exposed chains always creates a safety hazard, and in fact, there are documented cases of people having been badly injured after becoming entangled in such workings. In contrast, the present unit uses only direct drive from hydraulic motors which are fully sealed and do not create either the environmental or safety hazard problems of the prior art. An additional major benefit is that one saves the cost and the weight of a drive chain unit and possibly a separate prime mover.

Inasmuch as the invention is subject to many variations and modifications, it is intended that the foregoing shall be interpreted only as illustrative of the invention, whose full scope is set out in the following claims.

I claim:

1. An adapter for rendering an earth mover amphibious comprising a frame and a pair of pontoon assemblies, each such assembly including:

a pontoon attached to a respective end of said frame;

an endless track guided around the periphery of the pontoon;

a hydraulic motor having a stationary part attached to said pontoon, and a drive flange for driving the track around the pontoon; and a drive shaft assembly for transferring power from said hydraulic motor to said track, the drive shaft assembly comprising a tube disposed around the motor, having open end attached to said drive flange and a second end extending beyond the motor, a plate affixed to the other end of the tube, a shaft affixed to the plate and coaxial with the tube, the shaft extending from the plate in a direction away from the tube, a pillow block for supporting the distal end of the shaft, and a plurality of sprockets for driving the track, at least one of said sprockets being affixed to said tube and at least one of said sprockets being affixed to said shaft.

2. The invention of claim 1, wherein each of said pontoons has a bottom comprising a relatively short central section and pair of sloping sections, with a positive dihedral angle therebetween, attached to opposite ends of said central section, so as to render the pontoon easily pivotable upon the ground.

3. The invention of claim 1, wherein each of said tracks comprises a plurality of parallel chain loops with a series of spaced transverse cleats attached thereto, and each of said cleats comprises a crosspiece and a perpendicularly extending leg, with fillets at the intersection of the leg and crosspiece.

4. The invention of claim 3, wherein the fillets have a radius of at least one inch.

5. A drive shaft assembly for an earth mover having a pair of pontoons, tracks guided around each of said pontoons, and hydraulic motors for independently driving said tracks, the drive shaft assembly comprising a tube having inside diameter greater than the outer diameter of each hydraulic motor so that one end of the tube can be slipped over the motor, a drive flange affixed to a first end of the tube, a plate affixed to the other end of the tube, a shaft affixed to the plate coaxial with the tube and extending away from the latter, a pillow block for supporting the distal end of the shaft, and a plurality of sprockets for driving the track, at least one of said sprockets being affixed to said tube and at least one of said sprockets being affixed to said shaft.

* * * * *